US006517909B1

(12) United States Patent
Zaretsky et al.

(10) Patent No.: US 6,517,909 B1
(45) Date of Patent: Feb. 11, 2003

(54) METHOD FOR USING A PATTERNED BACKING ROLLER FOR CURTAIN COATING A LIQUID COMPOSITION TO A WEB

(75) Inventors: Mark C. Zaretsky, Rochester, NY (US); Steven A. Billow, Pittsford, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/697,526

(22) Filed: Oct. 26, 2000

Related U.S. Application Data

(63) Continuation-in-part of application No. 09/212,462, filed on Dec. 16, 1998, now abandoned.

(51) Int. Cl.[7] ..... B05D 1/30; B05D 3/14

(52) U.S. Cl. ..... 427/458; 427/470; 427/540; 427/420

(58) Field of Search ..... 427/458, 470, 427/540, 420

(56) References Cited

U.S. PATENT DOCUMENTS 3,531,314 A 9/1970 Kerr et al.
3,729,648 A 4/1973 Kerr
3,730,753 A * 5/1973 Kerr ..... 117/34
4,426,757 A * 1/1984 Hourticolon et al. ..... 29/121.8

FOREIGN PATENT DOCUMENTS

EP 390 774 B1 * 7/1992

* cited by examiner

*Primary Examiner*—Katherine A. Bareford
(74) *Attorney, Agent, or Firm*—Mark G. Bocchetti

(57) ABSTRACT

A method is taught for curtain coating a liquid composition onto a moving web at a coating point where the moving web is supported on a backing roller. The web is partially wrapped around the backing roller, the backing roller including a relief patterned area on the surface thereof, the relief patterned area including relieved features and non-relieved features, the relieved features and the non-relieved features creating an electrostatic force difference exerted on the liquid composition at the coating point when an electrostatic field is applied thereto. A web speed is specified and the electrostatic force difference exerted on the liquid composition at the coating point is varied to determine a maximum electrostatic force difference for the specified web speed that achieves the predetermined acceptable level of coating thickness non-uniformity. The web is moved at the specified web speed and an operating electrostatic force difference is generated at the coating point that is not greater than the maximum electrostatic force difference for the specified web speed.

18 Claims, 5 Drawing Sheets

METHOD FOR USING A PATTERNED BACKING ROLLER FOR CURTAIN COATING A LIQUID COMPOSITION TO A WEB

CROSS REFERENCE TO RELATED APPLICATIONS

This is a continuation-in-part of U.S. patent application Ser. No. 09/212,462, filed Dec. 16, 1998, now abandoned, entitled "Method For Using A Patterned Backing Roller For Curtain Coating A Liquid Composition To A Web," by Mark Zaretsky, et al.

Reference is made to commonly-assigned U.S. patent application Ser. No. 09/130,507, filed Aug. 6, 1998, entitled "Improved Coating Method Using Electrostatic Assist" by Zaretsky; U.S. patent application Ser. No. 09/185,045, filed Nov. 3, 1998, entitled "Method and Apparatus For Coating A Liquid Composition To A Web," by Billow et al., U.S. patent application Ser. No. 09/439,390, filed Nov. 11, 1999, entitled "Improved Coating Method Using Electrostatic Assist" by Zaretsky; and U.S. patent application Ser. No. 09/396,098, filed Sep. 15, 1999, entitled "Method and Apparatus For Coating A Liquid Composition To A Web," by Billow et al., the disclosures of which are hereby incorporated herein by reference.

FIELD OF THE INVENTION

The invention relates to methods and apparatus for coating a liquid composition onto a moving support web, and more particularly, to methods and apparatus for increasing the speed of coating application and for improving coating thickness uniformity of applied compositions in instances in which a high degree of uniformity is required.

BACKGROUND OF THE INVENTION

In the manufacture of many commercial products, such as photographic materials, a liquid composition is applied as a coating to a substrate. In many applications, and especially in imaging films and papers, the requirements for areal uniformity of coated thickness are highly demanding; thickness variations of less than 1% can be unacceptable for some products.

Known curtain coating apparatus typically includes a backing roller around which a web to be coated is wrapped and conveyed at a predetermined conveyance speed. A liquid composition is continuously delivered to and reshaped by an applicator, generally known as a hopper, from a jet flow at the applicator inlet into a broad ribbon of substantially uniform thickness at the applicator outlet from which it is dispensed onto the moving web. Such an applicator is generally positioned above the web at a distance of typically several centimeters, the composition being allowed to fall as a curtain under gravity into continuous contact with the moving web (curtain coating). A liquid composition may be a single layer or a composite layer consisting of a plurality of individual layers of coating compositions.

It is well known that electrostatic field variations created by non-uniform surface charge on the moving web can create objectionable coating non-uniformities. For example, corona discharge treatment of plastic-coated paper to improve adhesion of emulsion to the paper also creates non-uniform charge patterns that cause coating disturbances such as crosslines or mottle. Means for eliminating such charge patterns are disclosed in U.S. Pat. No. 3,531,314 using charged rollers and in U.S. Pat. No. 3,729,648 using ionizers.

The moving web carries with it a boundary layer of air on the front side (the side to be coated) and the back side (the side facing the backing roller). To prevent upsets in the coating and resulting coated thickness nonuniformities, each boundary layer of air must be eliminated before or at the coating point. The elimination of boundary layers becomes more difficult as coating speed is increased.

In all coating systems, there is an upper speed limit for coating at which the boundary layer of air carried on the web surface to be coated is no longer squeezed out by the advancing composition at the coating point, but rather becomes entrained under the composition, disrupting the uniform application thereof to the web and resulting in unacceptable coating non-uniformity.

It is well known that electrostatic charging of a web and/or coating apparatus can be useful in increasing this limit on coating speed, such process being referred to herein as electrostatic assist. For example, a dielectric web carrying a bound polar charge between opposite surfaces thereof can exhibit increased "wettability" and a consequent increase in acceptable coating speed when conveyed around a grounded coating roller. Means for applying such a charge to a web ahead of the coating point are disclosed, for example, in European Patent No. EP 390774; U.S. Pat. Nos. 4,835,004; 5,122,386; 5,295,039; and European Patent Application No. 0 530 752 A1.

Apparatus and methods also have been proposed for maintaining a uniform charge on a web between the charging apparatus and the coating roller. See, for example, U.S. Pat. No. 4,835,004 and European Patent Application No. 0 530 752 A1 which propose to prevent degradation of charge uniformity by imposing strict environmental controls around the web.

It is also known to apply electrostatic charge at the coating point by electrifying the surface of the coating roller itself. See, for example, U.S. Pat. Nos. 3,335,026; 4,837,045; and 4,864,460.

All of these techniques can be useful in electrostatically assisting the coating of a composition to a web by providing an electrostatic field between the composition and the backing roller at the point of coating. Such an assist acts to cause the composition to be drawn more aggressively toward the backing roller and thus to more forcefully squeeze out the front side boundary layer of air, permitting thereby an increase in coating speed which can be economically beneficial.

As noted above, a moving web also carries a boundary layer of air on its back side or surface as does the backing roller surface prior to engagement with the web. For every conveyance system there exists a speed at which conveyance is limited by back surface air entrainment between the web and the conveying roller. It is known to provide means to remove or exhaust the boundary layers of air being carried on the back surface of a web and the surface of a roller when the two come into contact, increasing thereby the tractional contact of the web with the roller. Such means may include, for example, a pressure-loaded nip roller urged toward the conveying roller, the web passing therebetween. However, use of a nip roller may not be particularly desirable, as it adds mechanical complexity to the apparatus, and a face-side nip roller can mar the surface of the web to be coated and can cause electrostatic disturbance of either or both of the web surfaces, resulting in coating non-uniformities.

Such means may also include a relief pattern formed in the surface of the conveying roller into which the back-side boundary layer air may be exhausted from the web and escape. See U.S. Pat. No. 3,405,855 issued Oct. 15, 1968 to Daly et al., for example. In this patent, Daly et al. teach the use of a roller having peripheral venting grooves and supporting land areas to vent air carried by the underside of the traveling web. Typically, for example, approximately 10% to 40% of the roller surface consists of grooves 0.5 mm to 2.4 mm in depth, 0.5 mm to 2.3 mm in width, and arranged from 5 mm to 15 mm apart. Another example is provided by U.S. Pat. No. 4,426,757 issued Jan. 24, 1984 to Hourticolon, et al. In this patent, Hourticolon, et al. teach the manufacture and use of a roller having a surface relief consisting of a "finely branched network of compression chambers," allowing the entrained air to be compressed into pockets rather than reducing the web traction. Both of these patents deal with purely conveyance roller issues and neither patent addresses the issue of electrostatic assist with such a roller surface pattern. A pattern on a backing roller creates a variable gap between the surface of the roller and the support being backed; that is, the gap to non-relieved areas of the roller surface is substantially zero, whereas the distance to the bottom of the relief may be up to 2.4 millimeter deep. This variable gap changes the capacitive relationship between the coating fluid and the backing roller, causing non-uniform electrostatic fields at the locus of the coating line. These electrostatic field variations can be comparable in magnitude to the previously described variations arising from non-uniform charge patterns created by corona discharge treatment and resulting in coating disturbances and coated thickness non-uniformities.

U.S. Ser. No. 09/185,045 teaches that the loss in electrostatic force over the relieved portions of the roller is less detrimental than the loss in electrostatic force caused by the intermittent lifting of the web from the backing roller while conveying at high coating speed (≧75 meters per minute or 125 centimeters per second) over a backing roll of large diameter (≧10 centimeters). Therefore, to prevent air entrainment between the web and the coating fluid, it is advantageous to use a relieved backing roller when using electrostatic assist at high coating speeds with a large backing roller.

For many coatings requiring only a modest level of uniformity, coating thickness variations on the order of 1% RMS (root mean square) or more, invention described in U.S. application Ser. No. 09/185,045 provides an adequate means to increase coating speeds resulting in acceptable coatings. However, it has been shown that the electrostatic force variations due to the relief pattern can cause non-uniformities in the resulting coating (see U.S. Pat. No. 5,609,923). For very sensitive coatings requiring a high degree of uniformity, coating thickness variations on the order of 0.3% RMS or less, the non-uniformities due to the use of a patterned roll with electrostatic assist can be prohibitive.

Thus there is a need for a method for coating a liquid composition to a moving web at high speed to produce a very uniform coated layer, wherein the backing roller is relieved in a pattern over a substantial portion of its cylindrical surface.

SUMMARY OF THE INVENTION

It is an object of the invention to provide an improved web coating method whereby a predetermined, uniform electrostatic charge on a relieved coating roller assists in providing a coating having excellent thickness uniformity and wherein the coating is applied to a moving web supported by a relieved backing roller.

It is a further object of the invention to provide an improved web coating method whereby webs may be coated to an excellent level of uniformity at high coating speeds.

It is a still further object of the invention to provide an improved, more operationally robust web coating method that is more tolerant of other operational variability.

Briefly stated, the foregoing and numerous other features, objects and advantages of the present invention will become readily apparent upon a review of the detailed description, claims and drawings set forth herein. These features, objects and advantages are accomplished by partially wrapping the moving web around the backing roller, the backing roller including a relief patterned area on the surface thereof, the relief patterned area including relieved features and non-relieved features, the relief patterned area being at least 30% of the width of the moving web, the relief patterned area being circumferential of the backing roller, the relieved features and the non-relieved features creating an electrostatic force difference exerted on the liquid composition at the coating point when an electrostatic field is applied thereto; specifying a predetermined acceptable level of coating thickness non-uniformity, the level of coating thickness non-uniformity increasing with an increase in electrostatic force difference and decreasing with an increase in web speed; specifying a web speed; varying the electrostatic force difference exerted on the liquid composition at the coating point, the electrostatic force difference determined by the relief patterned area, a capacitance of the moving web per unit area, and an electrostatic charge coating assist level, to determine a maximum electrostatic force difference for the specified web speed that achieves the predetermined acceptable level of coating thickness non-uniformity; dispensing the liquid composition from a curtain coating apparatus with a curtain height greater than or equal to 5 centimeters onto the moving web at the coating point; moving the web at the specified web speed; and generating an operating electrostatic force difference at the coating point that is not greater than the maximum electrostatic force difference for the specified web speed.

Alternatively, the curtain coating method of the present invention may be practiced by partially wrapping the moving web around the backing roller, the backing roller including a relief patterned area on the surface thereof, the relief patterned area including relieved features and non-relieved features, the relief patterned area being at least 30% of the width of the moving web, the relief patterned area being circumferential of the backing roller, the relieved features and the non-relieved features creating an electrostatic force difference exerted on the liquid composition at the coating point when an electrostatic field is applied thereto; specifying a predetermined acceptable level of coating thickness non-uniformity, the level of coating thickness non-uniformity increasing with an increase in electrostatic force difference and decreasing with an increase in web speed; specifying an electrostatic force difference exerted on the liquid composition at the coating point, the electrostatic force difference determined by the relief patterned area, a capacitance of the moving web per unit area, and an electrostatic charge coating assist level; varying the web speed to determine a minimum web speed for the specified electrostatic force difference that achieves the predetermined acceptable level of coating thickness non-uniformity; dispensing the liquid composition from a curtain coating apparatus with a curtain height greater than or equal to 5 centimeters onto the moving web at the coating point; generating the specified electrostatic force difference at the coating point; and moving the web at an operating speed that is not less than the minimum web speed for the specified electrostatic force difference.

In the practice of the method of the present invention, the electrostatic field extends through the web to produce an electrostatic "pressure" or "force" urging the liquid composition toward the front surface of the substrate at the coating point to exclude the front side air boundary layer, and the relief patterned surface of the backing roller dissipating the back side air boundary layer. It would be expected that using a relief patterned surface on the backing roller in an electrostatically assisted coating process would result in the reproduction of the pattern of the relief patterned surface in the coating laydown as a result of the electrostatic field variations at the liquid-air interface of the coating composition. Surprisingly, practicing the curtain coating method in the above described manner permits high coating speeds with essentially no reproduction of the relief pattern into the final coated thickness of the coating composition, the method being effective with both single- and multi-layer coatings.

In the practice of a preferred embodiment of the method and apparatus of the present invention, a substantially dielectric web to be coated (for example, a web formed from polyethylene terephthalate to be coated either with a single or multiple coatings of a gelatin-based aqueous emulsion) is first passed through means for dissipating all surface charges on the web. Preferably such means is disposed in the web conveyance path of a coating machine a short distance ahead of the point of entrance of the web onto the coating backing roller. An example of a suitable means for dissipating charges is a set of ionizers similar to that disclosed in U.S. Pat. No. 3,730,753 to Kerr, hereby incorporated by reference, wherein the web is exposed sequentially to one or more high positive charges and high negative charges to "flood" pre-existing charge variations on the web and is then discharged. Preferably, the web is also conditioned for coating by removal of residual free charge by treatment, for example, in accordance with the disclosure of U.S. Pat. No. 5,432,454, hereby incorporated by reference, as described in detail hereinbelow.

After being electrically neutralized, the web is entered onto an electrically-isolated backing roller having a relief pattern. The electrostatic stress variation experienced by the coating liquid over a relieved and non-relieved portion of the surface pattern can be characterized using the combination of the web capacitance per unit area and the dimensions of the relief pattern, and is represented by the normalized electrostatic force per unit area difference $F_{dif}$. The relief pattern covers the entire extent of the roller surface and has a web-roller contact area not greater than 70% (measured as the percentage of the roller surface that is non-relieved). The backing roller is located within a coating station wherein a coating applicator, for example, a hopper, provides a ribbon of liquid composition at a height greater than or equal to 5 centimeters above the backing roller for coating, according to the curtain coating method disclosed by J. F. Greiller (U.S. Pat. No. 3,632,374) and by D. J. Hughes (U.S. Pat. No. 3,508,947), thereby allowing the coating composition to enter a free-fall between the lip of the applicator and the surface of the web backed by the backing roller.

After determining a maximum coated thickness variation or non-uniformity NU and a preferred coating speed S, the following equation is used to determine the maximum allowable electrostatic charge coating assist level $V_{assist}$ that can be applied while achieving the coated thickness non-uniformity specification, $$NU = a_1 + a_2 V_{assist}^2 \frac{F_{dif}}{S} \quad (1)$$

wherein $a_1$ and $a_2$ are empirical constants.

The applicator is maintained at ground potential, and the roller is maintained at a DC potential of $V_{assist}$, either positive or negative, with respect to ground, creating an electrostatic field around the roller. The electrostatic field produces an electrostatic force that acts to propel the emulsion against the web, squeezing out the boundary layer of air being carried on the front surface of the web. At the same time, the patterned relief on the backing roller surface acts to vent the boundary layer of air being carried on the back surface of the web, increasing thereby the tractional contact of the web with the backing roller.

The practical result is enhanced apparent "wettability" of the web surface and an increase in the maximum coating speed achievable without onset of air entrainment at the coating point or disengagement of the web from the backing roller surface. Additionally, using the relationship described above in Equation 1 to determine either a minimum coating speed or a maximum electrostatic charge level, coating thickness variations can be kept at or below a predetermined acceptable level in spite of electrostatic force variations created by the relief pattern, thereby permitting electrostatically-assisted coating over a patterned roller at high speeds for coatings very sensitive to variations in coated thickness

DETAILED DESCRIPTION OF THE INVENTION

Figure 1:
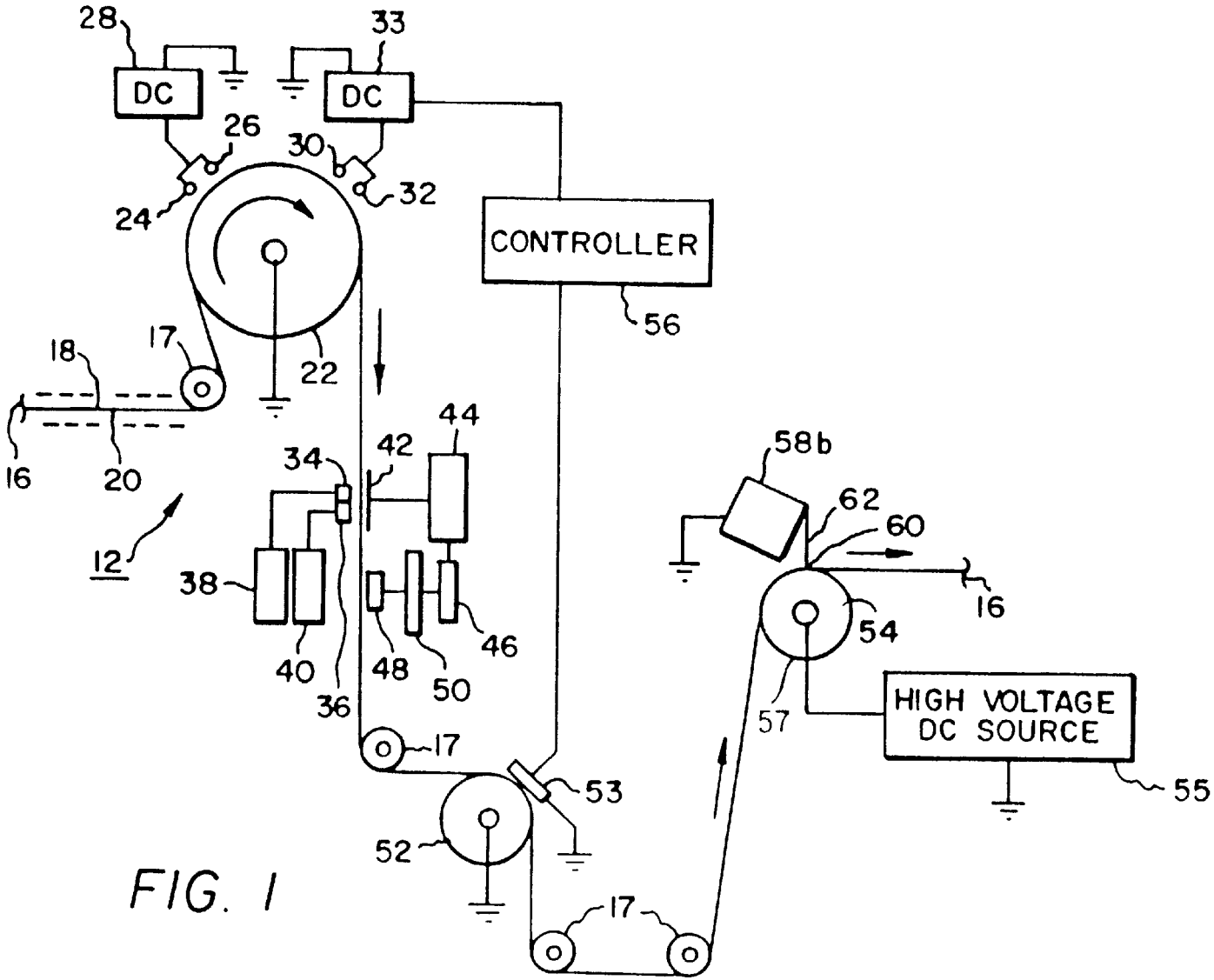
FIG. 1 is a schematic cross-sectional view of an apparatus for discharging a web and electrifying a relieved-surface coating backing roller prior to curtain coating of the web in accordance with the invention.

Referring first to FIG. 1 there is schematically shown an apparatus 10 for coating a liquid composition to a web in accordance with the present invention. Apparatus 10 includes a web charge-modification section 12 and an electrifiable coating section 14 for curtain coating the web 16.

Apparatus 10 is versatile in that electrostatic coating assist may be provided by section 12 without electrification of section 14, or by electrification of section 14 without installation or use of section 12, or preferably by use of both sections 12 and 14 together, as described below. The common element among these methods and apparatus configurations is that a voltage differential is created between the liquid composition and the upper surface 18 of web 16 at the coating point, preferably a voltage differential greater than at least about 300 volts. The voltage differential may be established by a number of methods. Preferably, the backing roller is electrified. Alternatively, the coating applicator 58*b* in section 14 may be electrified to provide the desired field at the coating point. Further, a charge may be delivered to the moving web prior to the coating point so that the web carries a charge into section 14. Additionally, the desired field at the coating point may be established by a combination of these charge delivery methods. In a preferred embodiment, described in detail below, the web is first electrified and then completely neutralized in section 12, so that the field providing electrostatic assist for coating derives only from the electrification in section 14.

In a presently preferred embodiment, a continuous web 16 having first and second surfaces 18, 20, is supplied to section 12 from a conventional unwinding and conveyance apparatus (not shown) and may be conveyed conventionally through the apparatus on generic rollers 17. Web 16 may be formed of any substantially non-conductive material including, but not limited to, plastic film, paper, resin-coated paper, and synthetic paper. Examples of the material of the plastic film are polyolefins such as polyethylene and polypropylene; vinyl copolymers such as polyvinyl acetate, polyvinyl chloride, and polystyrene; polyamide such as 6,6-nylon and 6-nylon; polyesters such as polyethylene terephthalate, and polyethylene-2 and -6 naphthalate; polycarbonate; and cellulose acetates such as cellulose diacetate and cellulose triacetate. The web may carry one or more coats of subbing material on one or both surfaces. The resin employed for resin-coated paper is typically a polyolefin such as polyethylene.

Web 16 may have patches of electrostatic charges disposed randomly over one or both surfaces 18, 20. In Section 12, charges on the web are adjusted. When section 14 is not electrified, the web in section 12 is provided with a residual charge of at least about 300 volts as measured by induction probe 53 at the exit of section 12. Various methods and apparatus known in the art, including but not limited to those disclosed in the patents recited hereinabove, may be suitable for charge modification in section 12 in accordance with the invention.

In an embodiment presently preferred for both plastic and paper webs, both sections 12 and 14 are provided, section 12 being used as follows. Web 16 is wrapped and conveyed around a grounded, conductive backing roller 22 with web surface 20 in intimate contact with the conductive surface 23 of roller 22. Web surface 18 is exposed to negatively charged electrodes 24, 26 which "flood" a large amount of negative charges onto surface 18. Electrodes 24, 26 may be electrically connected to the negative terminal of an adjustable 0–20 kV, 0–15 mA source 28 of DC potential. Grounded roller 22 acts as a counter electrode for electrodes 24, 26.

As web 16 is advanced along roller 22, it moves beneath electrodes 30, 32 which may be electrically connected to the positive terminal of a DC potential source 33 similar to source 28. Electrodes 30, 32 deposit a large amount of positive charges onto web surface 18 which neutralize the negative charge previously imparted to this surface by electrodes 24, 26. Grounded roller 22 functions as a counter electrode for electrodes 30, 32.

It will be understood by those skilled in the art that polarity of electrodes 24, 26 and 30, 32 may be reversed such that web surface 18 is "flooded" first with a large amount of positive charges and subsequently neutralized with a large amount of negative charges.

Web 16 is further conveyed about grounded roller 52 so that web surface 20 is in intimate contact with roller 52, the opposing web surface 18 being exposed to an induction probe 53 of a feedback control system comprising probe 53 and controller 56, which controller is responsive to the level of charge sensed by probe 53 and may be programmed to automatically adjust the level of charge applied by DC source 33 to electrodes 30, 32 to control the steady-state residual charge on surface 18 at any desired value. When section 14 is being electrified in addition to section 12 in accordance with the preferred embodiment of the invention, controller 53 is programmed to provide a residual voltage at probe 53 near or at zero.

The just-described electrostatic web treatment typically is sufficient to completely discharge all charges on surface 18 of the web and some of the charge on surface 20. However, some webs may retain some residual charge on surface 20 that may also be removed.

After leaving roller 22, web 16 is preferably conveyed past two fixed voltage or fixed DC current ionizers 34, 36 which are mounted near and facing surface 20 of web 16 on a free span of travel. The ionizers 34, 36 are mounted so that the central axis of each ionizer 34, 36 is oriented parallel to the web 16 in the transverse direction of the web 16. Each ionizer 34, 36 is electrically connected to a separate DC high voltage power supply 38, 40. A conductive plate 42 is positioned opposite ionizers 34, 36 facing surface 18 of web 16. Conductive plate 42 is electrically isolated from ground. Plate 42 can be of various shapes, designs, constructions, or materials, including both solid materials and screens, but plate 42 must incorporate at least a layer of conductive material to act as an equipotential surface to attract charge from ionizers 34, 36. A controllable bipolar high voltage source 44 is electrically coupled to plate 42 to deliver voltage to the plate over a wide range of positive and negative voltages (+/−5 kV). A feedback control system 46 preferably has a sensor or sensor array 48 responsive to the mean charge density residual on the web after treatment by the ionizers. High voltage source 44 may be adjusted manually to adjust the voltage level on plate 42 so that the plate voltage increases in the same polarity as a direct function of the residual charge density on the web 16; preferably, such adjustment is controlled automatically by electronic controller 50 to minimize the steady-state residual free charge on the web, preferably near or at zero.

As shown in FIG. 1, in section 14 web 16 is entered upon and wrapped partially around a backing roller 54 with the wrapped portion of the backing roller 54 including the coating point 60. Roller 54 is preferably electrically isolated and may be electrically connected to a high voltage DC source 55 to place a high potential on the surface 57 of backing roller 54, for example, 300 V, creating a standing electric field around roller 54. Coating applicator 58*b* is electrically grounded.

It is known in the coating art to relieve air pressure under a web being conveyed around a roller resulting from an entrained boundary layer of air on the back surface of the web 16 by providing a patterned relief in the surface of the roller. Such patterning can be very effective in allowing boundary layer air to escape either laterally or, more commonly, longitudinally of the web.

Figure 3:
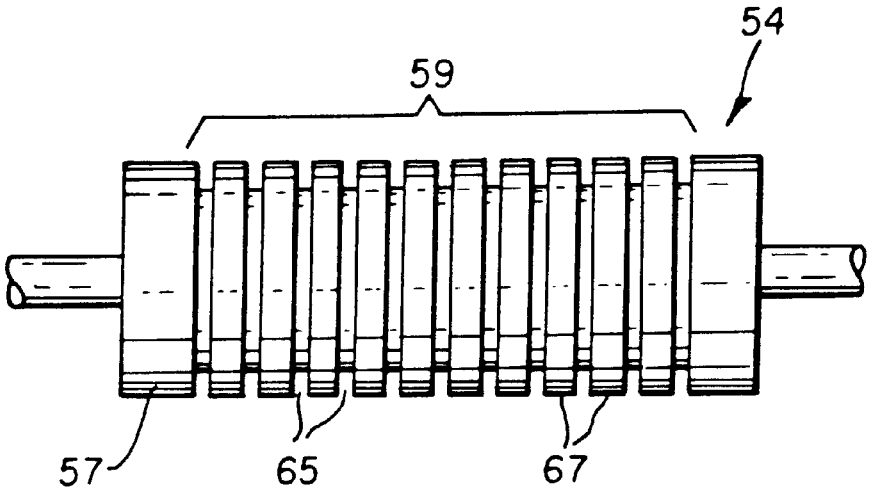
FIG. 3 is a cross-sectional view of a first embodiment of a relieved backing roller in accordance with the invention.
Figure 4:
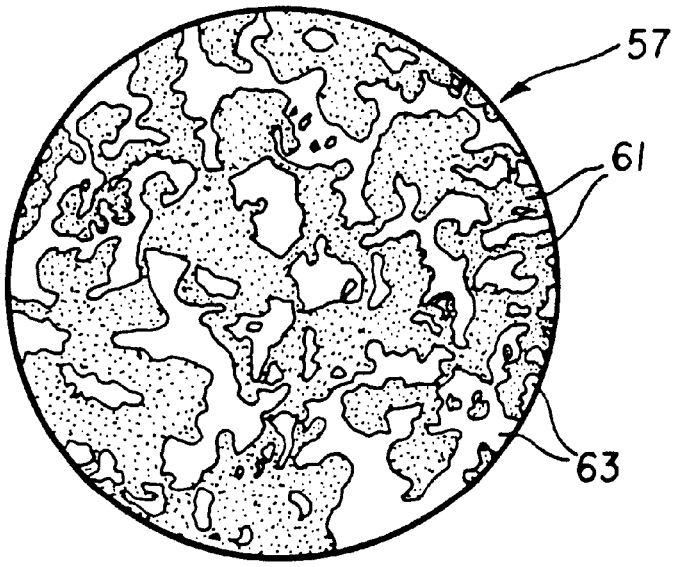
FIG. 4 is a plan view of a portion of the surface of a second embodiment of a relieved backing roller in accordance with the invention.

As is known in the art, relief patterning may take any of several forms. For example, a roller surface may be formed in a random pattern (see U.S. Pat. No. 4,426,757) or may be wound with spaced-apart turnings of wire (see U.S. Pat. Nos. 5,431,321 and 4,427,166). Such random pattern may be etched, machined, abraded, or shot-blasted to provide surface relief, which relief may comprise a finely branched collection of chambers and troughs 61 in the roller surface with adjacent plateau-like surfaces 63 presenting a generally cylindrical land area for supporting the web, as shown in FIG. 4 and taught by Hourticolon, et al. By plateau-like surface it is meant a surface having a topography that is relatively flat as compared to the depth of the chambers and troughs. More commonly, a roller is provided with a plurality of radial circumferential grooves, referred to herein as microgrooves, as shown in FIG. 3, for example, approximately 10% to 40% of the roller surface may consist of grooves 0.5 mm to 2.4 mm in depth, 0.5 mm to 2.3 mm in width, and arranged from 5 mm to 15 mm apart. In the practice of the present invention using a random pattern roller the branched collection of chambers and troughs should be in the range of from about 0.1 mm to about 1.3 mm in width and in the range of from about 0.02 mm to about 0.5 mm in depth.

In the practice of the method and apparatus of the present invention, coating backing roller 54 is provided with a relieved pattern 59 in the surface 57 thereof, which pattern may be a random pattern such as is shown in FIG. 4. However, coating backing roller 54 is preferably provided with a relieved pattern 59 in the form of a plurality of generally uniformly spaced, parallel circumferential grooves 65 and ridges 67 in the surface 57 of the roller as shown in FIG. 3. Ridges 67 present a generally cylindrical closely axially spaced land area for supporting the web 16 and permitting the web 16 to bridge the grooves 65, the grooves 65 being vented to ambient atmosphere at the oncoming and off-running sides of the area of web wrap of the roller 54. Such grooves 65 are similar to those described in U.S. Pat. No. 3,405,855 which are hereby incorporated by reference. Other groove widths, depths, and spacings may also be useful in practicing methods of the invention. In the practice of the present invention the grooves should be in the range of from about 0.1 mm to about 1.3 mm in width, and in the range of from about 0.02 mm to about 0.5 mm in depth.

Figure 5:
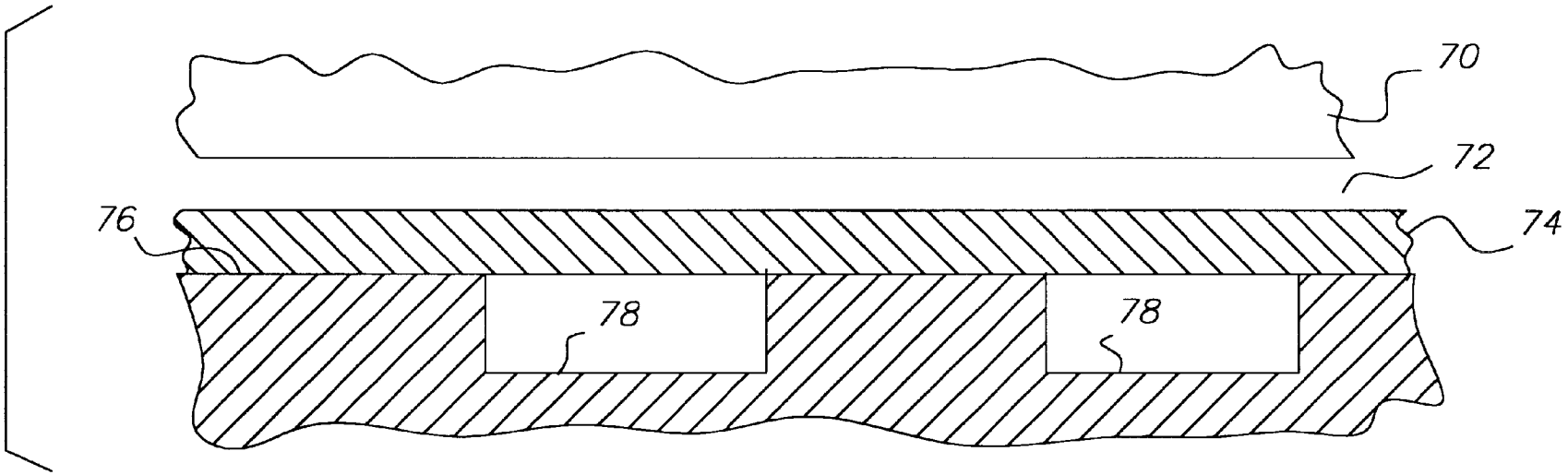
FIG. 5 is a rear elevational/partial sectional view looking in the machine direction from behind the liquid curtain of the coating liquid approaching the web which is supported on a roller having a grooved relief pattern illustrating the model geometry used for solving the electrostatic field problem.

A pattern may be considered acceptable in the practice of the present invention if it (1) provides adequate venting such that good contact between the web 16 and backing roller 54 is maintained at the desired coating speed as determined by comparison of web speed and roller surface speed and verifying they are in reasonable agreement; and (2) covers 30 percent or more of the width of the web 16 on the roller 54, preferably covering at least the center 30% portion of the width of the web 16. The normalized electrostatic force per unit area difference $F_{dif}$, representing the electrostatic force variation over a relieved and non-relieved portion of the surface pattern, for example, between the grooves 65 and ridges 67, can be calculated with an electrostatic field solver employing such methods as boundary element, finite element or finite difference. For the purposes of this invention, the electrostatic stress variation was calculated using a finite difference model. As shown in FIG. 5, this model has the coating liquid 70 as an upper electrode at ground potential, an air gap 72 of constant thickness ( for this calculation we look at the location where the liquid 70 approaches the web 74 and the gap therebetween is 30 $\mu$m), and then the web to be coated with its associated thickness, permittivity and incoming surface charges. Below the web 74 lies the coating roller surface 76, taken to be an equipotential at either ground or some non-zero potential. For purposes of this model, an equipotential of 1000V was assumed. Between the web 74 and the coating roller surface 76 is an air gap of varying thickness created by grooves 78 consistent with the geometry of the relief pattern.

The electrostatic stress (force/area) experienced by the coating liquid is computed using the following equation;

$$F=\tfrac{1}{2}\in_o E^2 \tag{2}$$

where $\in_o$ is the permittivity of free space and equals 8.854E-12 farads/m, and E is the electric field experienced by the liquid in units of volts/micrometer. This force/area will be a maximum, $F_{max}$, over the non-relieved portion of the surface pattern and will be a minimum, $F_{min}$, over the relieved portion. The difference between the maximum and the minimum force/area is normalized to the stress $F_{norm}$ experienced by the electrodes of a parallel plate, air gap capacitor having a combination of applied voltage and plate separation such that an electric field $E_{norm}$ of 10 volts/micrometer is produced;

$$F_{norm}=\tfrac{1}{2}\in_o E_{norm}{}^2 \tag{3}$$

Therefore, the normalized electric force/area difference $F_{dif}$ is computed as $$F_{dif} = \frac{F_{\max} - F_{\min}}{F_{norm}} \tag{4}$$

The coated thickness non-uniformity NU is calculated from coated samples and is expressed as a change in coated thickness from the nominal or average thickness. It may represent the local change in thickness of the entire liquid coating or perhaps a single layer of interest within a multilayer coating. in the case of periodic or pseudo-random patterns, performing these calculations in the frequency domain can improve signal-to-noise. The coated thickness non-uniformity is converted from spatial coordinates to frequency coordinates through the use of Fourier or similar analysis. The power-spectral-distribution (PSD) is then calculated and integrated over those frequencies produced by the relieved surface pattern that dominate in determining the normalized electrostatic force/area difference $F_{dif}$.

In a preferred embodiment of the invention, a desired coated thickness non-uniformity specification (in units of thickness) NU is selected, and a preferred coating speed S is also chosen. Based upon these parameter values and the $F_{dif}$ determined by the combination of the relieved surface pattern of the coating backing roller and the web capacitance per unit area, the following equation is then used to determine the maximum allowable electrostatic charge coating assist level $V_{assist}$, above which coated thickness non-uniformities arising from the relieved surface pattern would be expected to exceed the coated thickness non-uniformity specification;

$$NU = a_1 + a_2 V_{assist}^2 \frac{F_{dif}}{S}$$

wherein $a_1$ and $a_2$ are empirical constants and the web capacitance per unit area is given by the ratio of the web permittivity $\in$ to the web thickness d:

$$(C/A)=\in/d \tag{5}$$

It will be understood by those skilled in the art that the expression for the web capacitance per unit area may be more complex for multi-layered webs.

Coefficients $a_1$ and $a_2$ may be determined as follows. Conduct a simple set of designed coating experiments that explore the range of coating speed S, normalized electrostatic force/area difference $F_{dif}$, and electrostatic charge coating assist level of interest $V_{assist}$, and measure the coated thickness non-uniformity NU of the layer(s) of interest. Use Equation 1 and the experimental data to empirically determine coefficients $a_1$ and $a_2$ via a numerical technique such as a non-linear regression curve fitter. Those skilled in the art will understand that these coefficients may change as a function of the thickness of the air gap 72, application angle, curtain height, flow rate, viscosity, layer placement within the entire liquid coating or other process variables. For the specific conditions where the application angle is +35° (forward) from top-dead-center, the curtain height is 25 cm, the air gap thickness 72 is 30 micrometers, the bottom layer thickness is roughly 7 micrometers, the response is the % of non-uniformity %NU of the bottom layer due to the electrostatic field variations, the coating speed S is expressed in the units of m/s, and $V_{assist}$, is expressed in the units of volts, the values of $a_1$ and $a_2$ are 0.023 and 3.90E-7, respectively.

In another embodiment, a desired coated thickness non-uniformity specification NU is selected, and a preferred electrostatic charge coating assist level $V_{assist}$ is also chosen. Based upon these parameter values and the $F_{dif}$ determined by the combination of the relieved surface pattern of the coating backing roller and the web capacitance per unit area, a determination of the minimum allowable coating speed S, below which coated thickness non-uniformities arising from the relieved surface pattern would be expected to exceed the coated thickness non-uniformity specification, can be made by rearranging Equation 1 such that the parameter S appears on the left-hand side of the equation.

In yet another embodiment, a desired coated thickness non-uniformity specification NU is selected, and a preferred electrostatic charge coating assist level $V_{assist}$, web capacitance per unit area, and coating speed S are also chosen. Based upon these parameter values a determination of the maximum allowable normalized electrostatic force/area difference $F_{dif}$, above which coated thickness non-uniformities arising from the relieved surface pattern would be expected to exceed the coated thickness non-uniformity specification, can be made can be made by rearranging Equation 1 such that the parameter $F_{dif}$ appears on the left-hand side of the equation.

The electric field solver technique described earlier may then be used to compute the normalized electrostatic force/area variation for various relieved surface patterns for the coating backing roller to determine whether the pattern meets the maximum allowable $F_{dif}$. This allows one to properly design a new relieved surface pattern for the coating backing roller.

Thus, the electric field around roller 54 creates an electrostatic attractive force which acts to draw the curtain 62 of liquid composition aggressively against the surface 18 of web 16, thereby increasing the upper limit of coating speed without air entrainment into the liquid composition being applied. Simultaneously, the relieved pattern 59 in surface 57 allows the escape of air being carried as a boundary layer on surface 20 of web 16, thereby enhancing traction of the web on the roller and preventing the onset of web lifting from the roller surface, thereby minimizing any reduction in the electrostatic force felt by the fluid and maximizing its benefit. Furthermore, the coatings made by the above-described curtain coating method are free of coating artifacts that those skilled in the art would likely expect as a result of a reproduction of the groove pattern 59 (or the chambers and troughs 61) in the coating laydown. The coating exhibits a very high degree of thickness uniformity over the entire coated area of the web.

Figure 2:
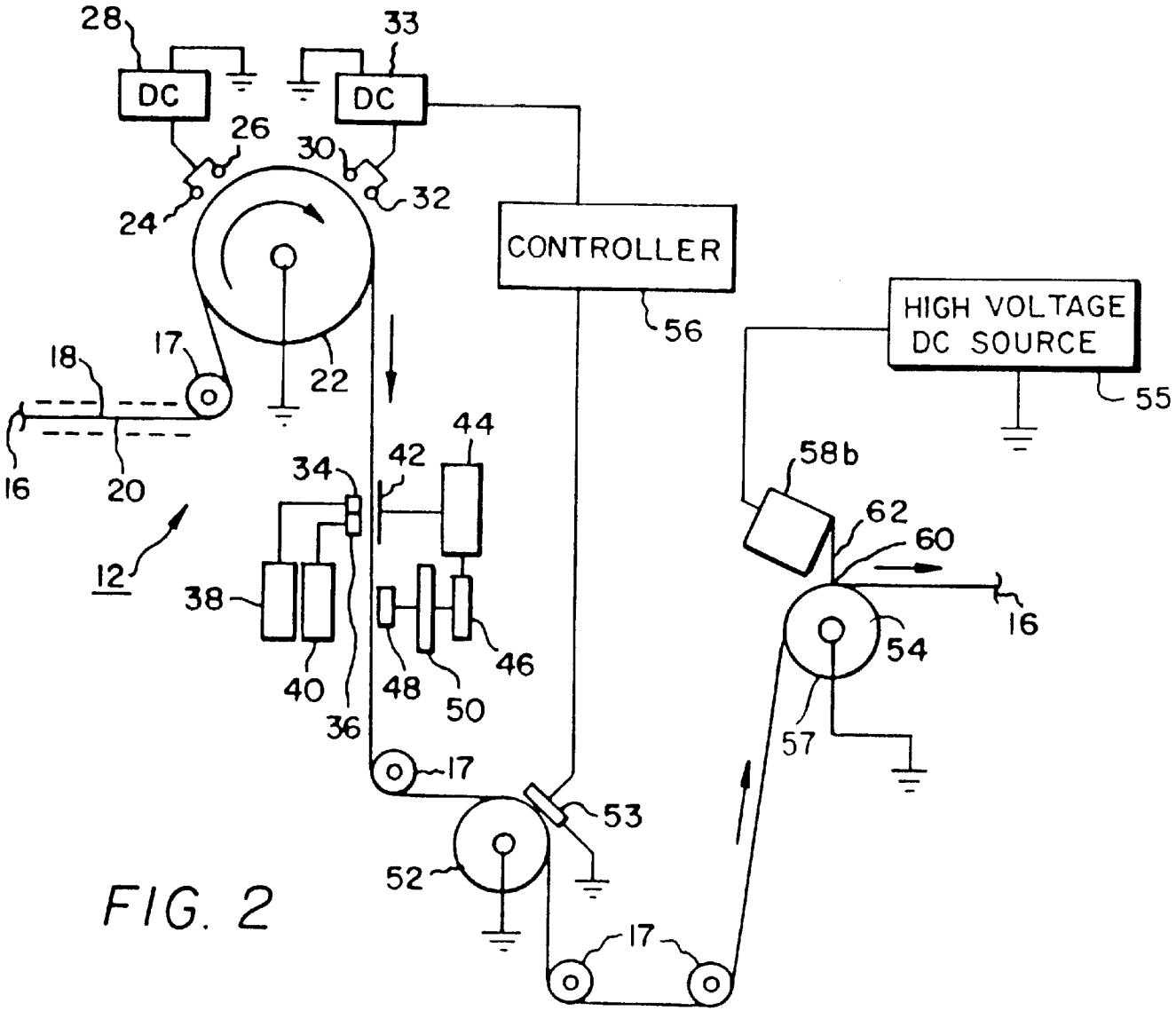
FIG. 2 is a schematic view like that in FIG. 1, showing the coating hopper as being electrified and the coating backing roller as being grounded.

An identical electrostatic attractive force at the coating point may be generated by exchanging the roles of the coating backing roller and the coating applicator, as shown in FIG. 2, such that the roller is grounded and the applicator is electrified. Because photographic compositions typically are electrically conductive, in such a configuration the entire composition delivery system must be electrically isolated to maintain the desired potential at the coating point. Further there is increased risk of electric shock to operating personnel and of fogging of product from inadvertent discharges. Therefore, in the preferred embodiment the applicator is grounded and the coating backing roller is electrified.

EXAMPLE 1

A multiple layer aqueous composition containing anywhere from 10% to 12.5% gelatin and a surfactant was curtain coated to a web of gelatin-subbed polyethylene terephthalate (0.1 mm thick and permittivity of $3.2\epsilon_o$) being conveyed on a backing roller with a diameter of 20 cm. The total flow rate ranged from 1.5 to 2.0 cc/cm/sec. A carbon dispersion was added into the bottom layer of the coating to provide a means to assess the coating uniformity. The coated thickness of this bottom layer was held constant at about 7 $\mu$m. The curtain height was 25 cm, the application angle was +35° (forward) from top-dead-center and the roller diameter was 20 centimeters. Two different relief patterns were tested. For Roller A, the relief pattern consisted of a set of circumferential grooves, each groove being about 0.08 mm deep and 0.4 mm wide with about a 1 mm center-to-center spacing between adjacent grooves. When combined with the web capacitance/area, the normalized electrostatic force/area difference $F_{dif}$ was computed to be approximately 2.0. For Roller B, the relief pattern consisted of a set of circumferential grooves, each groove being about 0.15 mm deep and 0.5 mm wide with about a 1 mm center-to-center spacing between adjacent grooves. When combined with the web capacitance/area, the normalized electrostatic force/area difference $F_{dif}$ was computed to be approximately 2.3.

Over a range of speeds and backing roller voltages, the intensity of the non-uniformity caused by reproduction of the relief pattern on the backing roller was measured (at the spatial frequency of 1 cycle/mm). Charge on the web was neutralized before entering the coating. The following table summarizes these results:

| Speed (m/s) | Voltage (V) | Roller A | Roller B |
|---|---|---|---|
| 2.5 | 500 | NOT VISIBLE | NOT VISIBLE |
| 2.5 | 700 | MARGINAL | DEFECT |
| 2.5 | 1000 | DEFECT | DEFECT |
| 5.0 | 500 | NOT VISIBLE | NOT VISIBLE |
| 5.0 | 700 | NOT VISIBLE | NOT VISIBLE |
| 5.0 | 1000 | MARGINAL | DEFECT |
| 7.5 | 500 | NOT VISIBLE | NOT VISIBLE |
| 7.5 | 700 | NOT VISIBLE | NOT VISIBLE |
| 7.5 | 1000 | NOT VISIBLE | NOT VISIBLE |

where NOT VISIBLE indicates that the non-uniformity was not visible in the coated sample and DEFECT indicates that an unacceptable non-uniformity was visible by eye. In the one case labeled MARGINAL, the imperfection was just barely visible in only portions of the coating.

These results can be compared to what we would expect from Equation 1. Using 0.18% non-uniformity of this sensitive bottom layer as our non-uniformity requirement (0.0126 $\mu$m thickness variation), the acceptability of these coatings could have been determined before the coating was conducted. The table below gives the predicted non-uniformity (in %) caused by the variation in electrostatic force for all these conditions using Equation 1.

| Speed (m/s) | Voltage (V) | Roller A | Roller B |
|---|---|---|---|
| 2.5 | 500 | 0.10 | 0.11 |
| 2.5 | 700 | 0.18 | 0.20 |
| 2.5 | 1000 | 0.33 | 0.38 |
| 5.0 | 500 | 0.06 | 0.07 |
| 5.0 | 700 | 0.10 | 0.11 |
| 5.0 | 1000 | 0.18 | 0.20 |
| 7.5 | 500 | 0.05 | 0.05 |
| 7.5 | 700 | 0.07 | 0.08 |
| 7.5 | 1000 | 0.13 | 0.14 |

As shown in the above tables, Equation 1 is useful in indicating the likeliness of seeing an imperfection in the coating due to the electrostatic variations caused by the patterned coating roller.

EXAMPLE 2

Applying electrostatic assist can have many benefits as it stabilizes the coating process and can permit coating at conditions that were previously unattainable. Frequently, it is desired to know how much electrostatic assist can be applied to a given coating condition to gain the maximum benefit of the electrostatic assist but not suffer the non-uniformity which can occur if the electrostatic force variations at the coating liquid exceed allowable limits. In this example, consider a product with coating conditions that are fixed except for the level of electrostatic assist. The coating roller is circumferentially grooved with grooves 0.15 mm deep, 0.42 mm wide, and spaced 1.0 mm apart, center-to-center. The support to be coated is a web of gelatin-subbed polyethylene terephthalate, 0.1 mm thick and a permittivity of $3.2\in_o$. These parameters give a $F_{dif}$ of approximately 2.3. The coating speed is fixed at 3.5 m/s. Furthermore, this product is known to be sensitive to thickness variations and that any thickness variation in any of its layers greater than 0.00761 $\mu$m caused by electrostatic field variations will be deemed unacceptable by the customer. Using Equation 1, it may be found that the maximum allowable voltage in this circumstance is 615 Volts. Coating at or below this voltage threshold will ensure that no coating non-uniformity due to electrostatic field variations resulting from the patterned roller will be greater than the prescribed 0.0076 $\mu$m in any of the product's coated layers.

EXAMPLE 3

Equation 1 can be used to determine if coating speed will be acceptable for a given product if the force ratio and voltage are fixed. Consider a product that requires excellent uniformity of its coated layers. It is known that if the imaging layer suffers a non-uniformity greater than 0.18% from the nominal thickness, the non-uniformity will be visible to the customer and unacceptable for use.

Figure 6:
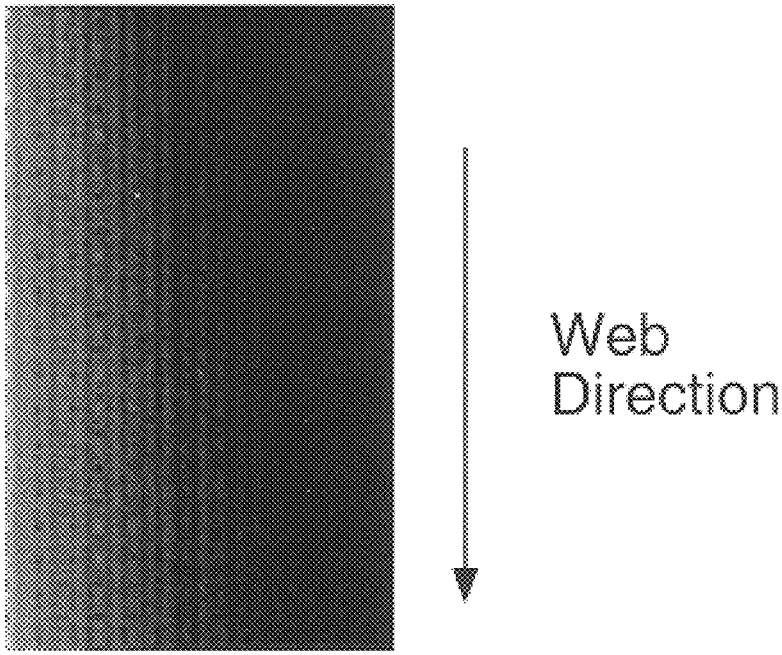
FIG. 6 is a photograph of a liquid coating obtained according to conditions given in Example 3 at a coating speed of 2.5 meters/second; the image is printed at two-times actual scale.

Initially, suppose the product was designed to utilize electrostatic assist to improve its coating performance. The proposed coating conditions consisted of using a 25 cm high curtain, a flow rate of 3.5 cc/cm/s, an application angle of +35 degrees (where the angle is measured from top-dead-center and considered positive in the direction of web travel), and a coating speed of 2.5 m/s. The support to be coated is a web of gelatin-subbed polyethylene terephthalate, 0.1 mm thick and a permittivity of $3.2\in_0$. The coating composition was approximately 12% aqueous gelatin and the backing roller, a circumferentially grooved roller with grooves 0.15 mm deep, 0.42 mm wide, and spaced 1.0 mm apart, center-to-center, ($F_{dif}$ of approximately 2.3) was biased to 1000V. Using Equation 1 above, one would expect a level of non-uniformity of 0.38%, significantly above the acceptable limit for this product. Indeed, when the conditions were attempted, the coating roller pattern was imaged in the coating thickness, giving a thickness variation in excess of 0.18% and the non-uniformity was clearly visible in the product as shown in FIG. 6.

Figure 7:
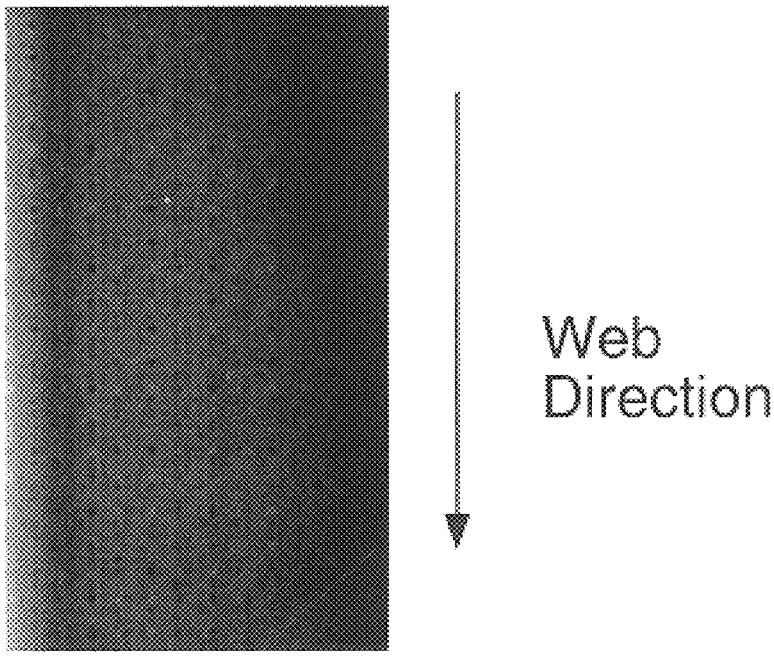
FIG. 7 is a photograph of a liquid coating obtained according to conditions given in Example 3 at a coating speed of 6.25 meters/second; the image is printed at two-times actual scale.

For the second attempt, Equation 1 was consulted to determine an improved coating condition. It was found that by increasing the coating speed to 6.25 m/s, the expected non-uniformity would be significantly reduced, to approximately 0.17%, meeting the product requirement. Keeping everything but the coating speed constant did indeed give an acceptable product without visible coating non-uniformity due to the patterned roller as shown in FIG. 7.

EXAMPLE 4

Hypothetically, a new product is proposed to coat on an existing coating machine. This product is known to be unacceptable if its coating non-uniformity exceeds 0.2% deviation from a nominal thickness of 6.4 $\mu$m. It has been found that the product can be coated at coating speeds from 2.5 m/s to 7.5 m/s if the coating roller voltage is maintained at a minimum of 1100 Volts. The base for this proposed product and coating roller pattern on the machine intended to use to manufacture it combine to give a $F_{dif}$ of 2.5. Equation 1 may now be used to determine the minimum acceptable coating speed to produce an acceptable coating. This speed is found to be approximately 6.8 m/s. By meeting or exceeding this speed, the coating engineer can feel comfortable that the coating non-uniformity due to the non-uniform electrostatic field caused by the roller pattern will not result in unacceptable product.

EXAMPLE 5

Hypothetically, assume that a new coating facility is being designed to coat a sensitive product. This product is known to be unacceptable if its coating non-uniformity exceeds 0.18%. Furthermore, to be profitable, it must be coated at a minimum speed of 5 m/s. Previous coating studies have found that it is most robust when coated at an application angle of +20 degrees, a curtain height of 25 cm, and with 1200 V supplied to its coating roller to supply an electrostatic assist. Therefore, the coating roller relief pattern must be designed so as not to generate a coating non-uniformity exceeding 0.18% at these conditions. Using Equation 1 and solving for $F_{dif}$, one finds that the normalized electrostatic force/area difference may not exceed 1.37 at the minimum coating speed of 5 m/s. Using this datum, the roller designers can explore all roller relief pattern and web combinations that will produce a force ratio less than this threshold.

The many features and advantages of the invention are apparent from the detailed specification and thus it is intended by the appended claims to cover all such features and advantages which fall within the true spirit and scope of the invention. Further, since numerous modifications and changes will readily occur to those skilled in the art, it is not desired to limit the invention to the exact construction and operation illustrated and described, and accordingly all suitable modifications and equivalents may be resorted to, falling within the scope of the invention.

PARTS LIST

10 electrostatic coating assist apparatus
12 charge-elimination section
14 electrified coating section
16 continuous web
17 web conveyance rollers
18 first web surface
20 second web surface
22 conductive backing roller in 12
24 first negative electrode
26 second negative electrode
28 DC source to drive 24,26
30 first positive electrode
32 second positive electrode
33 DC source to drive 30,32
34 first DC ionizer
36 second DC ionizer
38 power supply for 34
40 power supply for 36
42 conductive plate
44 bipolar high voltage source
46 feedback control system
48 sensor
50 electronic controller
52 grounded roller
53 induction probe
54 coating backing roller
55 high voltage DC source
56 controller
57 conductive surface of 54
58 coating applicator
59 relieved pattern in 57
60 coating point
61 chambers and troughs
62 curtain of coating composition
63 plateau-like surfaces
65 grooves
67 ridges
70 coating liquid
72 air gap of constant thickness
73 web
76 coating roller surface
78 air gap of varying thickness

What is claimed is:

1. A method for curtain coating a liquid composition onto a moving web at a coating point where the moving web is supported on a backing roller, the method comprising the steps of:

(a) partially wrapping the moving web around the backing roller, the backing roller including a relief patterned area on the surface thereof, the relief patterned area including relieved features and non-relieved features, the relief patterned area being at least 30% of the width of the moving web, the relief patterned area being circumferential of the backing roller, the relieved features and the non-relieved features creating an electrostatic force difference exerted on the liquid composition at the coating point when an electrostatic field is applied thereto;

(b) specifying a predetermined acceptable level of coating thickness non-uniformity, the level of coating thickness non-uniformity increasing with an increase in electrostatic force difference and decreasing with an increase in web speed;

(c) Drying a web speed;

(d) varying the electrostatic force difference exerted on the liquid composition at the coating point, the electrostatic force difference determined by the relief patterned area, a capacitance of the moving web per unit area, and an electrostatic charge coating assist level, to determine a maximum electrostatic force difference for the specified web speed that achieves the predetermined acceptable level of coating thickness non-uniformity, (e) displaying the liquid composition from a curtain coating apparatus with a curtain height greater than or equal to 5 centimeters onto the moving web at the coating point;

(f) moving the web at the specified web speed; and (g) generating an operating electrostatic force difference at the coating point that is not greater than the maximum electrostatic force difference for the specified web speed.

2. A method as recited in claim 1 wherein the electrostatic force difference is determined by:

(a) determining a maximum electrostatic force $F_{max}$ exerted on the liquid composition at the coating point over the non-relieved features of the surface pattern;

(b) determining a minimum electrostatic force $F_{min}$ exerted on the liquid composition at the coating point over the relieved features of the surface pattern, both of the determining steps being performed using the equation $$F=\tfrac{1}{2}\in_o E^2$$

wherein $\in_o$ is the permittivity of free space and equals 8.854E-12 farads/m, and E is the electric field experienced by the liquid in units of volts/micrometer; and (c) calculating the electrostatic force difference by subtracting the minimum electrostatic force from the maximum electrostatic force.

3. A method as recited in claim 2 further comprising the step of:

normalizing an electrostatic force/area difference, $F_{dif}$, defined by the equation $$F_{dif} = \frac{F_{\max} - F_{\min}}{F_{norm}}$$

wherein $F_{norm}$ is defined by $$F_{norm}=\tfrac{1}{2}\in_o E_{norm}^{\ 2}$$

and $E_{norm}$ equals 10 volts/micrometer.

4. A method as recited in claim 3 wherein:

step (d) of claim 1 is performed using the algorithm $$NU = a_1 + a_2 V_{assist}^2 \frac{F_{dif}}{S}$$

wherein:

NU is a desired coated thickness non-uniformity specification (in units of thickness), S is the specified web speed, $V_{assist}$, is the maximum allowable electrostatic charge coating assist level, and $a_1$ and $a_2$ are empirical constants.

5. A method as recited in claim 1 wherein:

the relief patterned area comprises a plurality of generally uniformly aligned circumferential grooves and ridges, the ridges presenting a smooth generally cylindrical closely axially spaced land area for supporting the web and permitting the web to bridge the grooves, the grooves being vented to ambient atmosphere at oncoming and off-running sides of the area of web wrap of the roller and wherein the grooves are in the range of 0.1 mm to 1.3 mm in width and in the range of 0.02 mm to 0.5 mm in depth.

6. A method as recited in claim 1 wherein:

the relief patterned area comprises a branched collection of chambers and troughs in the roller surface with adjacent plateau-like surfaces presenting a smooth generally cylindrical land area for supporting the web, wherein the branched collection of chambers and troughs are in the range of 0.1 mm to 1.3 mm in width and in the range of 0.02 mm to 0.5 mm in depth.

7. A method as recited in claim 1 further comprising the step of:

neutralizing the electrostatic charges on the web prior to the coating point.

8. A method as recited in claim 1 wherein height of the liquid curtain is greater than or equal to 25 centimeters.

9. A method as recited in claim 1 wherein:

the electrostatic field has a strength equivalent to that produced by applying a voltage differential of at least about 300 V between the backing roller and the coating fluid.

10. A method for curtain coating a liquid composition onto a moving web at a coating point where the moving web is supported on a backing roller, the method comprising the steps of:

(a) partially wrapping the moving web around the backing roller, the backing roller including a relief patterned area on the surface thereof, the relief patterned area including relieved features and non-relieved features, the relief patterned area being at least 30% of the width of the moving web, the relief patterned area being circumferential of the backing roller, the relieved features and the non-relieved features creating an electrostatic force difference exerted on the liquid composition at the coating point when an electrostatic field is applied thereto;

(b) specifying a predetermined acceptable level of coating thickness non-uniformity, the level of coating thickness non-uniformity increasing with an increase in electrostatic force difference and decreasing with an increase in web speed;

(c) specifying an electrostatic force difference exerted on the liquid composition at the coating point, the electrostatic force difference determined by the relief patterned area, a capacitance of the moving web per unit area, and an electrostatic charge coating assist level;

(d) varying the web speed to determine a minimum web speed for the specified electrostatic force difference that achieves the predetermined acceptable level of coating thickness non-uniformity;

(d) dispensing the liquid composition from a curtain coating apparatus with a curtain height greater than or equal to 5 centimeters onto the moving web at the coating point;

(e) generating the specified electrostatic force difference at the coating point; and (f) moving the web at an operating speed that is not less than the minimum web speed for the specified electrostatic force difference.

11. A method as recited in claim 10 wherein the electrostatic force difference is determined by:

(a) determining a maximum electrostatic force $F_{max}$ exerted on the liquid composition at the coating point over the non-relieved features of the surface pattern; and (b) determining a minimum electrostatic force $F_{min}$ exerted on the liquid composition at the coating point over the relieved features of the surface pattern, both of the determining steps being performed using the equation $$F=\tfrac{1}{2}\in_o E^2$$

wherein $\in_o$ is the permittivity of free space and equals 8.854E-12 farads/m, and E is the electric field experienced by the liquid in units of volts/micrometer; and (c) calculating the electrostatic force difference by subtracting the minimum electrostatic force from the maximum electrostatic force.

12. A method as recited in claim 11 further comprising the step of:

normalizing an electrostatic force/area difference, $F_{dif}$, defined by the equation $$F_{dif} = \frac{F_{\max} - F_{\min}}{F_{norm}}$$

wherein $F_{norm}$ is defined by $$F_{norm}=\tfrac{1}{2}\in_o E_{norm}^2$$

and $E_{norm}$ equals 10 volts/micrometer.

13. A method as recited in claim 12 wherein:

step (d) of claim 2 is performed using the algorithm $$NU = a_1 + a_2 V_{assist}^2 \frac{F_{dif}}{S}$$

wherein:

NU is a desired coated thickness non-uniformity specification (in units of thickness), S is the minimum allowable web speed, $V_{assist}$, is the specified electrostatic charge coating assist level, and $a_1$ and $a_2$ are empirical constants.

14. A method as recited in claim 10, wherein:

the relief patterned area comprises a plurality of generally uniformly aligned circumferential grooves and ridges, the ridges presenting a smooth generally cylindrical closely axially spaced land area for supporting the web and permitting the web to bridge the grooves, the grooves being vented to ambient atmosphere at oncoming and off-running sides of the area of web wrap of the roller and wherein the grooves are in the range of 0.1 mm to 1.3 mm in width and in the range of 0.02 mm to 0.5 mm in depth.

15. A method as recited in claim 10 wherein:

the relief patterned area comprises a branched collection of chambers and troughs in the roller surface with adjacent plateau-like surfaces presenting a smooth generally cylindrical land area for supporting the web, wherein the branched collection of chambers and troughs are in the range of 0.1 mm to 1.3 mm in width and in the range of 0.02 mm to 0.5 mm in depth.

16. A method as recited in claim 10 further comprising the step of:

neutralizing the electrostatic charges on the web prior to the coating point.

17. A method as recited in claim 10 wherein height of the liquid curtain is greater than or equal to 25 centimeters.

18. A method as recited in claim 10 wherein:

the electrostatic field has a strength equivalent to that produced by applying a voltage differential of at least about 300 V between the backing roller and the coating fluid.

* * * * *

UNITED STATES PATENT AND TRADEMARK OFFICE

CERTIFICATE OF CORRECTION

PATENT NO. : 6,517,909 B1 
DATED : February 11, 2003
INVENTOR(S) : Mark C. Zaretsky et al.

It is certified that error appears in the above-identified patent and that said Letters Patent is hereby corrected as shown below:

Column 15,
Line 65, please replace the text "(c) Drying a web speed;" with the following corrected text -- (c) specifying a web speed; --

Column 16,
Line 8, please replace the text "(e) displaying the liquid…" with the following corrected text -- (e) dispensing the liquid… --

Signed and Sealed this

Fifteenth Day of July, 2003

JAMES E. ROGAN
*Director of the United States Patent and Trademark Office*